United States Patent [19]

Kuzuya et al.

[11] Patent Number: 4,741,641

[45] Date of Patent: May 3, 1988

[54] TRACTOR HAVING AN ENDLESS BELT WITH DRIVING PINS

[75] Inventors: Susumu Kuzuya, Gifu; Akira Asai, Nagoye; Yoshiyuki Karube, Nagoye; Yoshikatsu Hirata; Tetsuro Ueno, both of Toyoake, all of Japan

[73] Assignee: Brother Kogyo Kabushiki Kaisha, Japan

[21] Appl. No.: 19,739

[22] Filed: Feb. 27, 1987

[30] Foreign Application Priority Data

Feb. 27, 1986 [JP] Japan ..... 61-28411[U]

[51] Int. Cl.[4] ..... B41J 11/26

[52] U.S. Cl. ..... 400/616.2

[58] Field of Search ..... 400/616.2, 616.1; 474/144, 146, 147; 226/74

[56] References Cited

U.S. PATENT DOCUMENTS

| | | | |
|---|---|---|---|
| 3,209,972 | 10/1965 | Benbow et al. | 226/74 |
| 3,392,893 | 7/1968 | Bennett et al. | 226/74 |
| 3,825,162 | 4/1974 | Hubbard | 226/74 |
| 4,079,633 | 3/1978 | Cheema et al. | 74/229 |
| 4,453,660 | 6/1984 | Cornell et al. | 226/74 |
| 4,614,287 | 9/1986 | Ueno et al. | 226/74 |

*Primary Examiner*—Edgar S. Burr
*Assistant Examiner*—James A. Lisehora
*Attorney, Agent, or Firm*—Jones, Tullar & Cooper

[57] ABSTRACT

A pair of pulleys are rotatably provided between a pair of long frames in the neighborhood of both ends thereof. An endless belt is put over the pulleys, wherein the teeth which mesh with the pulleys are provided on the inner surface of the endless belt. A row of pins which fit into the perforations in a document is provided in the outer feeding surface of the endless belt. A groove extending in the longitudinal direction of the belt is formed in the central portion of the teeth trains of the belt. A rib projecting from the upper surface on which the belt slides and extending in the feeding direction of the document is formed in one of the frames. Since the belt moves in a state in which the rib is fitted into the groove of the belt, the belt runs without deviating from the line which connects between the pulleys.

6 Claims, 6 Drawing Sheets

TRACTOR HAVING AN ENDLESS BELT WITH DRIVING PINS

BACKGROUND OF THE INVENTION

The present invention relates to a tractor having an endless belt with driving pins, which feeds documents having perforations along their margins to a given printing position within a printer.

The tractor is used in a printer which is used; as computer peripheral equipment or the like. The tractor is provided in a pair of rows of perforations of a document, respectively. The respective tractors comprise a pair of pulleys spaced-apart in the feeding direction of the document. The pulleys are rotatably supported at both sides of a pair of frames extending in the feeding direction. An endless belt extends between both pulleys, and a large number of pins project from the outer feeding surface of the endless belt at regular intervals.

In the tractor, one of two pulleys is inserted into a driving shaft which is connected to the drive-source of a pulse motor and a D.C. servomotor or the like. The other pulleys or the frames are inserted into a guide shaft, which is provided in parallel to the driving shaft.

The documents are mounted on the tractor so as to cause the feeding perforations punched in both ends to engage the pins of the tractor. Then, when the driving pulley is rotated and driven by the driving source through the driving shaft, the belt is rotated and driven between the two pulleys by the rotation of the pulley. The pins move in association with the rotation of the belt, and thereby the documents are fed to the printing position.

The documents are also in a state such that the central portion in the width direction is loosened by the dead load when the feeding perforations at both ends of the documents are engaged with the pins of the tractor. And the wider the documents, the greater the amount of slackening, and therefore it is liable to generate an inferior quality of printing or paper jams. Therefore, in order not to cause the documents to slacken, the tractor is positioned and fixed in the driving shaft and the guide shaft so as to draw the documents toward the outside width by means of the pins.

At this time, when the force of the tractor to draw the documents is too strong, the feeding perforations are torn or, conversely the portion of the belt positioned between a pair of pulleys is drawn toward the opposite side through the documents, and therefore the belt curves against the feeding direction. In this state, when documents are fed, the feeding perforations will not engage with the pins, and therefore the documents will be fed in a curve to the printing position, or the documents will be damaged, and thus it will be impossible to feed the documents.

SUMMARY OF THE INVENTION

The object of the present invention is to provide a tractor which can reliably feed documents, by which the documents are smoothly fed without slipping to one or the other side, and which avoids the situation in which it is impossible to feed due to damage to the documents or the feeding perforations thereof.

According to the present invention, there is provided a tractor which feeds documents having two rows of perforations. The tractor comprises a pair of pulleys spaced-apart in the feeding direction of the documents. A pair of frames extending in the feeding direction of the documents comprise a pair of pulley supporting portions spaced-apart in the feeding direction thereof, respectively. Whereby, the pulleys are rotatably supported in the pulley supporting portions of the frames. An endless belt links the pulleys. The endless belt includes a plurality of pins arranged in the outer feeding surface thereof at regular intervals, a plurality of teeth provided in the inner surface thereof and engaging with the pulleys, and an engaging portion formed along the endless belt in the inner surface thereof. The portion to be engaged, which is engaged with the engaging portion between the pulleys, limits the running locus of the endless belt so as not to cause the endless belt to deviate from the feeding direction of the document.

In the present invention, a row of perforations in the document is engaged with a row of pins on the endless belt. In the printer, a pair of tractors are, respectively, provided in the position which matches with the rows of perforations along the edges of the document. Accordingly, a row of perforations of the document is also engaged with a row of pins of the endless belt of the other tractor. In this case, in order not to cause the document to be loosened in the lateral direction thereof, a suitable tension is applied to the document, and the pair of tractors is fixed.

The endless belt moves in one direction by the rotation of the pulleys and feeds the document in one direction through the pins and perforations. In this case, since the portion to be engaged is engaged with the engaging portion of the inner surface of the endless belt, the endless belt will not curve in a lateral direction against the feeding direction of the document thereof. Accordingly, the running locus of the endless belt is limited by the engaging portion and the portion to be engaged, and curving of the endless belt is prevented by the tension of the document. Accordingly, the endless belt moves smoothly and the document is smoothly and reliably fed.

DETAILED DESCRIPTION OF THE PREFERRED EMBODIMENTS

Figure 1:
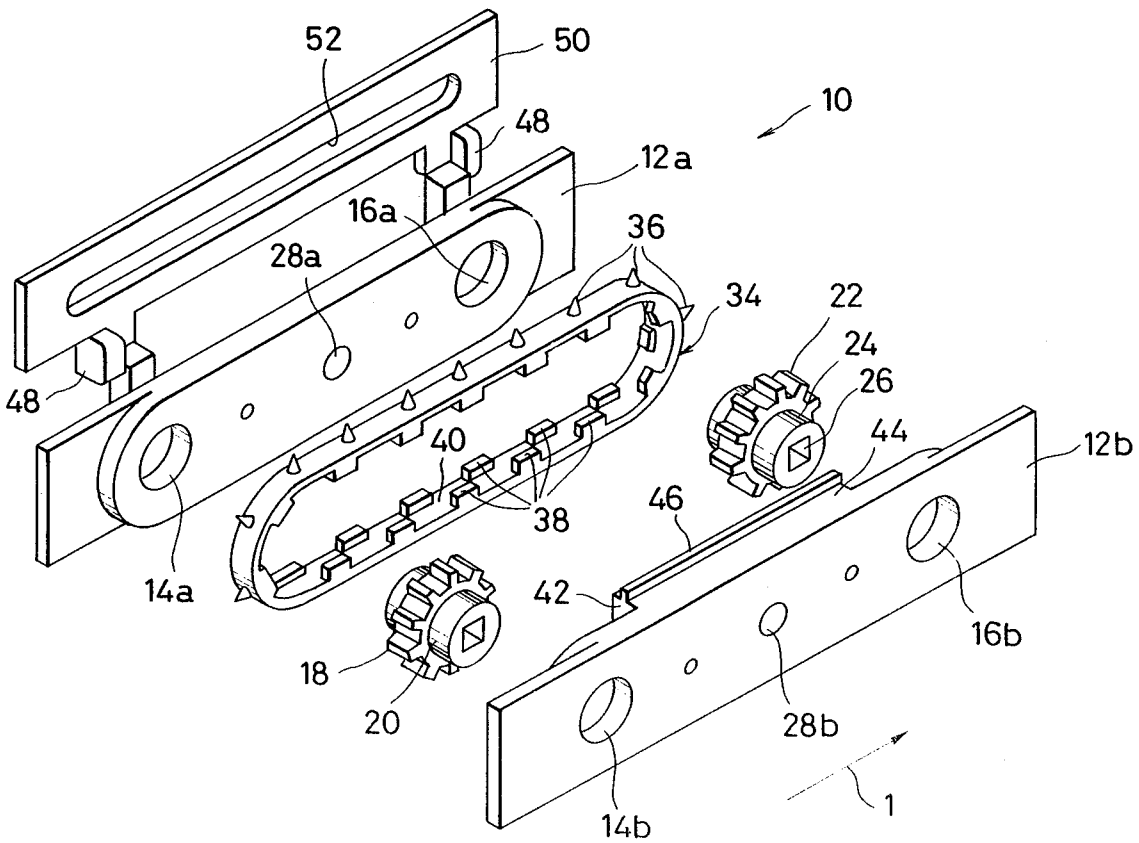
FIG. 1 is an exploded view in perspective of the tractor concerning the first embodiment of the present invention.
Figure 2:
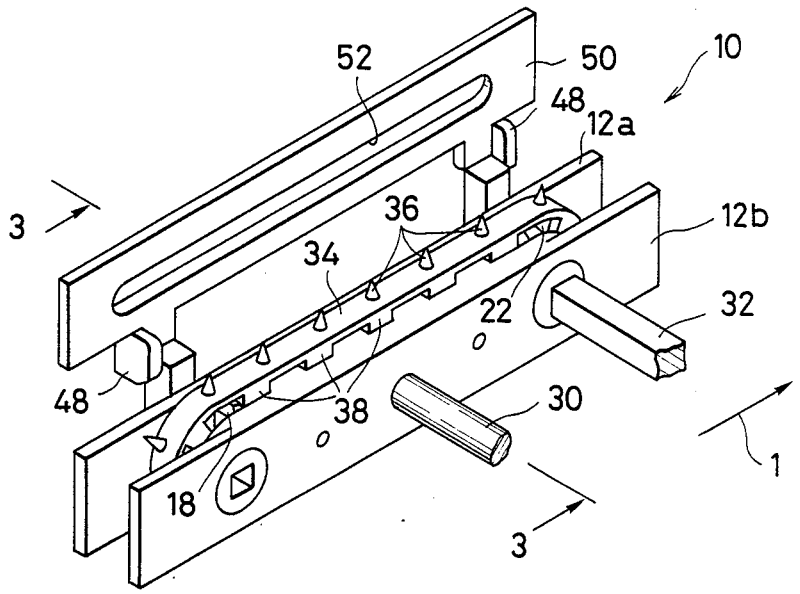
FIG. 2 is a perspective view of the tractor of the first embodiment of the present invention.
Figure 3:
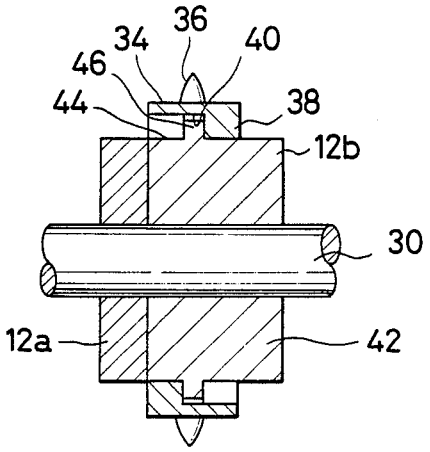
FIG. 3 is a sectional view taken through line 3—3 in FIG. 2.

FIGS. 1 to 3 show the tractor of the first embodiment of the present invention. In the printer, the tractor 10 shown in FIG. 2 is provided in the neighborhood of the edges of a document in both sides of a platen (not shown), respectively (only one tractor 10 is shown in FIG. 2).

The respective tractors 10 comprise a pair of frames 12*a*, 12*b* extending in the feeding direction of a document shown by an arrow 1. Circular holes 14*a*, 14*b* and 16*a*, 16*b* are, respectively, formed in the respective frames 12*a*, 12*b* at the front and the rear of the printer (the rear and the front of a feeding direction of the document.)

A pair of pulleys 18, 22 are coaxially secured to shaft members 20, 24 having an outer peripheral surface, respectively. The shaft member 20 is fitted into the circular holes 14*a*, 14*b* of the frames 12*a*, 12*b*, and the shaft member 24 is fitted into the circular holes 16*a*, 16*b* of the frames 12*a*, 12*b*. Whereby, the pulleys 18, 22 are rotatably supported to the frames 12*a*, 12*b* through the shaft members 20, 24. The respective pulleys 18, 22 have a plurality of teeth formed along a circumference thereof at regular intervals.

The frames 12*a*, 12*b*, respectively, have guide holes 28*a*, 28*b* at the central portion thereof. A guide shaft 30 is inserted into the guide holes 28*a*, 28*b* as shown in FIG. 2. The guide shaft 30 is also inserted into guide holes (not shown) which are formed in the frame (not shown) of the other of the tractors. Accordingly, a pair of tractors 10 can be brought together or separate by sliding them along the guide shaft 30. Whereby, the interval between both tractors can be adjusted in response to the width of the document. A driving shaft 32 having a rectangular shape in section, which is connected to a suitable driving source (not shown) is provided in parallel with the guide shaft 30. The driving shaft 32 is inserted into a rectangular throughole 26 which is formed in the shaft member 24 of the pulley 22 in the rear of the printer. Whereby, the pulley 22 is rotated and driven through the driving shaft 32. Accordingly, the pulley 22 is a driving pulley and the pulley 18 is a driven pulley.

An endless belt 34 links the pulleys 18 and 22. In the outer feeding surface of the belt 34, a plurality of pins 36 which will fit into the perforations of the document are projected at regular intervals.

Further, as shown in FIG. 1, a plurality of teeth 38 are provided in the inner peripheral surface of the belt 34. These teeth 38 have a smaller width than half the width of the teeth of the pulleys 18, 22, and are alternately provided in both side-portions of the belt 34. And in the central portion of the lateral direction on the inner peripheral surface of the belt 34, teeth are not provided. Whereby, a groove 40 sandwiched by the teeth 38 and extending in the longitudinal direction of the belt 34 is formed in the central portion of the lateral direction on the inner peripheral surface of the belt 34.

On the inside surface (the surface facing the frame 12*a*) of the frame 12*b*, a guide frame 42 is integrally formed together with the frame 12*b*. The guide frame 42 is located in the region surrounded by the belt 34 when the tractor is assembled as shown in FIG. 2. The guide frame 42 has an upper surface 44 of the same height as the upper surface of the frame 12*b*, and the teeth 38 of the belt 34 slide on the upper surface 44. Whereby, slackness of the belt 34 is prevented by the guide frame 42. A rib 46 extending in the direction of arrow 1 (a moving direction of the belt 34) is projected in the central portion of the upper surface 44 of the guide frame 42. The height of the rib 46 is slightly lower than that of the teeth 38 of the belt 34. Rib 46 is fitted into the groove 40 of the belt 34. Accordingly, the belt 34 is guided by the rib 46 to move along the rib 46 (FIG. 3). Therefore, even if a force perpendicular to the moving direction of the belt 34 is applied to the belt 34, the moving locus of the belt 34 will not curve because the belt is limited by the rib 46.

A guide plate 50 is rotatably mounted in the upper end of the frame 12*a* on the frame 12*a* by a bearing 48. A slot 52 extending in the direction of the arrow 1 (the feeding direction of the document) is formed in the guide plate 50. The pins 36 of the belt 34 are inserted into the slot 52 when the guide plate 50 is rotated to cover or close the upper edges of the frames 12*a*, 12*b*. Accordingly, when the belt 34 moves, the slot 52 is the passage through which the pins 36 pass. After fitting the perforations of the document onto the pins 36 of the belt 34, when the guide plate 50 closes the upper end of the frames 12*a*, 12*b*, the document is sandwiched between the guide plate 50 and the belt 34. Whereby, the document is securely engaged with the pins 36 and is driven by the belt 34.

Next, an explanation is given with reference to the operation of the tractor 10 which has been configured in this way. When the document is attached to the tractor 10, a pair of tractors 10 which are provided on both sides of the platen are slid along the driving shaft 32 and the guide shaft 30 to adjust the interval between both to the interval in response to the width of the document. Next, the guide plate 50 is set in the open state, and the feeding perforations of the document are fitted onto the respective pins 36 of the belt 34, and the guide plate 50 is closed. In this way, the tips of the pins 36 are engaged with the slot 52 of the guide plate 50, and the engagement of the feeding perforations of the document and the pins 36 is held by the guide plate 50. In this state, when the driving shaft 32 is rotated and driven, the driving pulley 22 rotates and therefore the belt 34 is turned between both pulleys 18 and 22. In association with the turning of the belt 34, the teeth 38 of the belt 34 which are disengaged from the teeth of the driven pulley 18 slide on the upper surface 44 of the guide frame 42 while causing the side surfaces defining the groove 40 thereof to engage with the side surfaces of the rib 46. Further, the pins 36 move between the frames 12*a* and 12*b* from the front of the printer to the rear. In this way, the document is guided between the upper surface of the belt and the guide plate 50 to be moved to the printing position while contacting with only the upper surface (the outer feeding surface) of the belt 34.

Wherein, when the document has been attached to the tractor 10, in case the central portion in a direction of width of the document is loosened by its dead load, a pair of tractors 10 are slid along the driving shaft 32 and the guide shaft 30 in the direction that extends the interval therebetween to eliminate the slackening of the document. In this way, the document is fed to the printing position without generating a paper jam. At this time, the rib 46 of the guide frame 42 is fitted into the groove of the belt 34 between both pulleys 18 and 22. Whereby, since the side surfaces of the teeth 38 of the belt 34 engage with the side surfaces of the rib 46, the deviation of the belt 34 to the direction of the width is limited. Accordingly, the belt 34 is not drawn by the document and therefore the belt will not curve against the direction of rotation (direction of arrow 1). Accordingly, the document is smoothly fed to the printing position without curving or being damaged.

Further, the belt 34 may be a belt comprising the teeth 38 which are formed in the inner peripheral surface along the longitudinal direction thereof and engaged with the teeth of pulleys 18 and 22, and the groove 40 which is formed in the central portion of the respective teeth. Namely, as shown in FIG.1, it is not always necessary to alternately provide the teeth.

Figure 4:
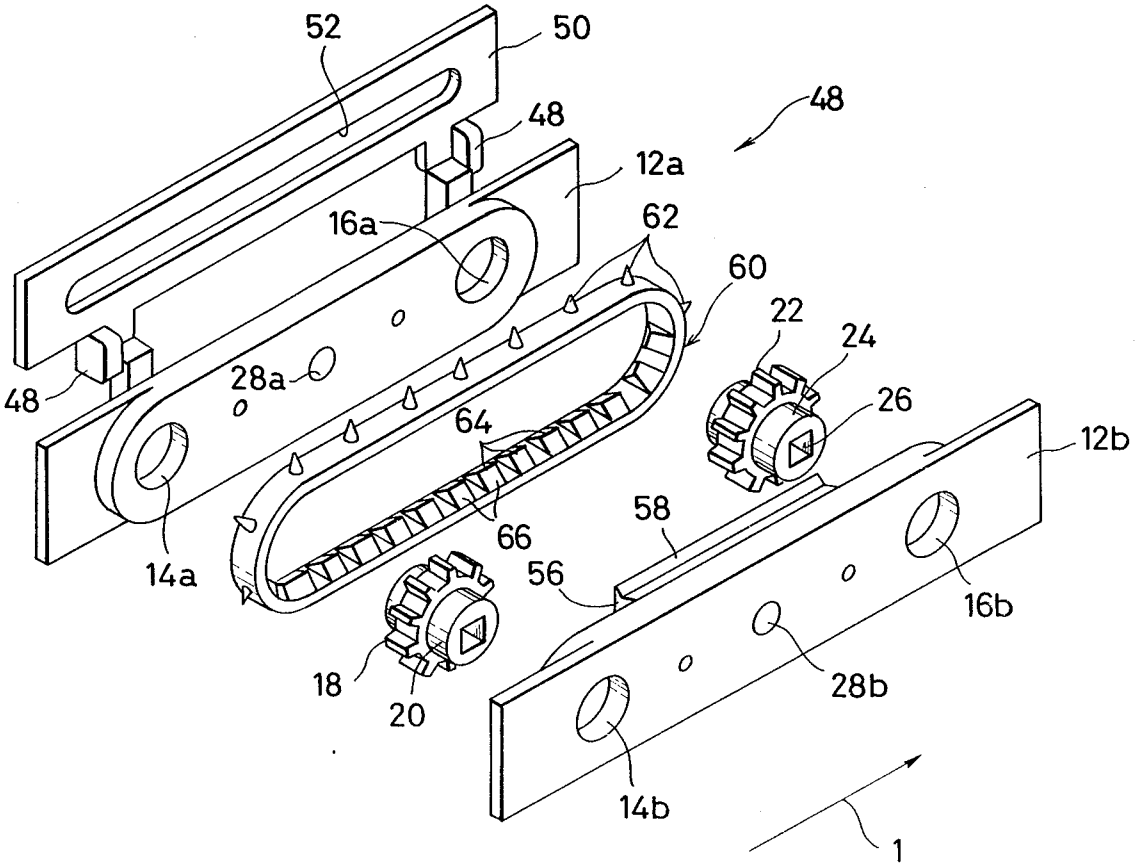
FIG. 4 is an exploded view in perspective of the tractor of the second embodiment of the present invention.
Figure 5:
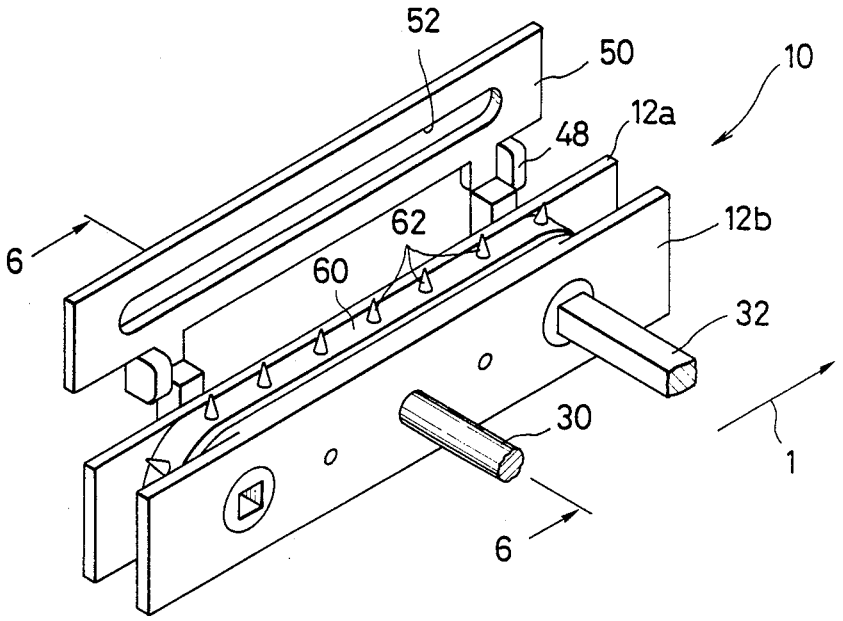
FIG. 5 is a perspective view of the tractor of the second embodiment of the present invention.
Figure 6:
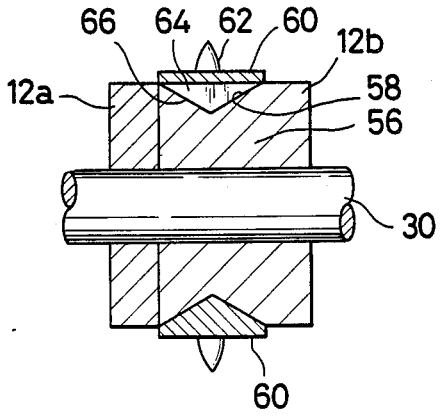
FIG. 6 is a sectional view taken through the line 6—6 in FIG. 5.

Next, an explanation of the tractor 48 concerning the second embodiment in accordance with the present invention will be given by referring to FIGS. 4 to 6. In FIGS. 4 to 6, the same elements as FIGS. 1 to 3 of the first embodiment are given the same reference numerals to omit the explanation.

An endless belt 60 links the pulleys 18 and 22. On the outer feeding surface of the belt 60, a plurality of the pins 62 are provided. Further, on the inner surface of the belt 60, a plurality of teeth 64 which have a V-shaped section are projected at an interval of the same pitch as that of the pulleys 18 and 22. Accordingly, when the belt 60 is put over pulleys 18 and 22, the teeth of the pulleys 18 and 22 mesh with the teeth 64 of the belt 60.

A guide frame 56 is integrally formed in the frame 12*b*. In the upper surface of the guide frame 56, a V-shaped groove 58 extending in the direction of arrow 1 is formed. When the belt 60 has been put over the pulleys 18 and 22, as shown in FIG. 6, the slanting surfaces 66 (surfaces forming the V-shape) of the teeth 64 of the belt 60 engage with the V-shaped groove 58 of the guide frame 56. Whereby, even if the belt 60 is drawn in a direction which is perpendicular to the document feeding direction (the direction of the arrow 1), the running locus of the belt 60 will not curve.

The document is attached to the tractor 48 which has been configured as mentioned above, in a similar way to the tractor 10 of the first embodiment, and when the driving pulley 22 is rotated and driven, the belt 60 is turned between both pulleys. In association with the rotation, the teeth 64 of the belt 60 which are disengaged from the teeth of the driven pulley 18 slide toward the driving pulley 22 while the slanting surfaces 66 thereof engage with the V-shaped groove 58 of the guide frame 56. Further, the pins 62 move between the frames 12*a* and 12*b* from the front of the printer to the rear. In this way, the document is guided between the upper surface thereof and the guide plate 50 to be fed to the printing position while sliding on and contacting only with the upper surface (the outer feeding surface) of the belt 60.

Wherein, when the document has been attached to the tractor 48, in case that the central part in the lateral direction of the document is loosened by the dead load, the document is fed to the printing position without generating a paper jam by sliding the tractors 48 to eliminate the slackening of the document, in a similar way to the first embodiment. At this time, since the slanting surfaces 66 of the teeth 64 of the belt 60 are engaged with the V-shaped groove 58 of the guide frame 56 between both pulleys, the deviation of the belt from a feeding direction of the document is prevented, and the belt 60 is not drawn by the document and therefore the belt will not curve against the direction of turning. Accordingly, the document is fed in the printing position without curving or being damaged.

Further, the tractor concerning the present invention is not limited to the above-mentioned first and second embodiments, and various changes and modifications may be applied thereto in its broader aspects while not altering the spirit or the scope thereof. For example, in the first embodiment, a groove along the circumference, in place of the rib 46, is provided in both pulleys 18, 22, and an O-ring which is formed of an elastic member such as rubber is extended between the pulleys 18 and 22 by fitting it into the groove. The O-ring fits into the groove 40 of the belt 34 which links both pulleys, and since the deviation of the belt 34 from the running locus is prevented, the belt 34 will not curve. Further, since the O-ring limits the deviation of the belt 34 to the lower side, the guide frame 42 is not required.

What is claimed is:

1. A tractor having an endless belt with driving pins, which feeds a document, having two rows of perforation, in a given direction comprising:

a pair of pulleys spaced-apart in the feeding direction of the document;

a pair of frames extending in the feeding direction of the document, each frame having a pair of pulley-supporting portions spaced in the feeding direction of the document for rotatably supporting the pair of pulleys;

an endless belt linking the pair of supported pulleys, the belt having an inner surface and an outer feeding surface, a plurality of pins arranged on the outer feeding surface thereof at regular intervals, a plurality of teeth provided on the inner surface thereof which engage with said pair of pulleys, wherein all of the teeth on the endless belt have a width smaller than half the width of the belt and are formed along both lateral side portions of the belt, so that the central portion, viewed in the lateral direction of the belt, is free of teeth, and an engaging portion formed along the endless belt on the inner surface thereof; and a guide member provided between said pair of supported pulleys for limiting the endless belt to prevent slack in the endless belt, the guide member including a portion to be engaged for limiting the running locus of the endless belt so as not to cause the endless belt to deviate from the feeding direction of the document, said guide member portion to be engaged being engaged with said endless belt engaging portion between said pulleys.

2. The tractor according to claim 1, in which said central portion defines said engaging portion of the endless belt as a groove extending between the teeth situated along both lateral side portions.

3. The tractor according to claim 2, in which said guide member has an upper surface which is contacted by the inner surface of the endless belt for relative sliding contact therewith, and a rib extending in a running direction of the belt, which projects from a central portion of said upper surface of the guide member, said rib being engaged with said groove.

4. The tractor according to claim 3, in which said teeth are alternately arranged along both lateral side-portions on the inner surface of the belt.

5. The tractor according to claim 6, in which said guide member has an upper surface which is contacted by the inner surface of the endless belt for relative sliding contact therewith, and a V-shaped groove formed in the upper surface of the guide member which is engaged by said slanting surface.

6. A tractor having an endless belt with driving pins, which feeds a document, having two rows of perforation, in a given direction comprising:

a pair of pulleys spaced-apart in the feeding direction of the document;

a pair of frames extending in the feeding direction of the document, each frame having a pair of pulley-supporting portions spaced in the feeding direction of the document for rotatably supporting the pair of pulleys;

an endless belt linking the pair of supported pulleys, the belt having an inner surface and an outer feeding surface, a plurality of pins arranged on the outer feeding surface thereof at regular intervals, a plurality of teeth provided on the inner surface thereof which engage with said pair of pulleys wherein all of the teeth on the endless belt each have an inverted V-shaped section, viewed in the lateral direction of the belt, each V-shaped section defining a slanting surface, and an engaging portion formed along the endless belt on the inner surface thereof; and a guide member provided between said pair of supported pulleys for limiting the endless belt to prevent slack in the endless belt, the guide member including a portion to be engaged for limiting the running locus of the endless belt so as not to cause the endless belt to deviate from the feeding direction of the document, said guide member portion to be engaged being engaged with said endless belt engaging portion between said pulleys.

* * * * *

UNITED STATES PATENT AND TRADEMARK OFFICE

CERTIFICATE OF CORRECTION

PATENT NO. : 4,741,641

DATED : May 3, 1988

INVENTOR(S) : KUZUYA, Susumu et al

It is certified that error appears in the above-identified patent and that said Letters Patent is hereby corrected as shown below:

Column 6, line 53, change "5" to --6--; and
change "6" to --5--

Column 6, line 59, change "6" to --5--

Signed and Sealed this

Twenty-eighth Day of November 1989

*Attest:*

JEFFREY M. SAMUELS

*Attesting Officer* *Acting Commissioner of Patents and Trademarks*